United States Patent [19]

Patton et al.

[11] 4,258,788

[45] Mar. 31, 1981

[54] CPI CASING

[75] Inventors: Franklin D. Patton, West Vancouver; James D. McFarlane, Vancouver, both of Canada

[73] Assignee: Westbay Instruments Ltd., West Vancouver, Canada

[21] Appl. No.: 926,646

[22] Filed: Jul. 21, 1978

[51] Int. Cl.[3] ..... E21B 23/00

[52] U.S. Cl. ..... 166/185; 175/45; 166/191

[58] Field of Search ..... 166/191, 127, 147, 242, 166/117.5, 185, 100, 264, 241; 285/330, DIG. 14, 24, 27; 175/4.51, 45, 44, 321, 40, 405, 239, 257–261, 247–249; 405/251, 252

[56] References Cited

U.S. PATENT DOCUMENTS

| | | | |
|---|---|---|---|
| 967,395 | 8/1910 | Langhaar | 285/DIG. 14 |
| 1,875,395 | 9/1932 | Salisbury | 405/48 |
| 2,079,830 | 5/1937 | Baker et al. | 166/187 X |
| 2,177,601 | 10/1939 | Smith | 166/187 X |
| 2,196,658 | 4/1940 | Burt | 166/187 X |
| 2,235,318 | 3/1941 | Halliburton | 166/147 |
| 2,280,785 | 4/1942 | Boynton | 73/151 X |
| 2,399,125 | 4/1946 | Lenhard, Jr. | 166/147 |
| 2,471,759 | 5/1949 | Lowrey | 285/330 X |
| 2,750,569 | 6/1956 | Moon | 285/330 X |
| 2,897,897 | 8/1959 | Breakelman | 166/191 X |
| 3,035,639 | 5/1962 | Brown et al. | 166/187 X |
| 3,254,673 | 6/1966 | MacKenzie | 285/330 X |
| 3,287,032 | 11/1966 | Kraybill | 285/330 |
| 3,460,618 | 8/1969 | Blagg | 166/187 X |
| 3,465,836 | 9/1969 | Fields | 175/4.51 |
| 3,578,079 | 5/1971 | Alexander | 166/187 |
| 4,031,957 | 6/1977 | Sanford | 166/264 |

*Primary Examiner*—James A. Leppink
*Assistant Examiner*—Richard E. Favreau
*Attorney, Agent, or Firm*—Fulwider, Patton, Rieber, Lee & Utecht

[57] ABSTRACT

A unit adapted to be attached to a large number of similar units to form an apparatus to permit the taking of geological and geophysical readings and samples. The apparatus comprises a cylindrical casing having ribs or grooves formed on its interior surface. A coupler is adapted to fit on the casing. Alignment means are formed on the casing and the coupler to co-operate to ensure alignment of the grooves in the casing with the grooves in an adjacent casing in the apparatus. Expandable bags may be attached to the exterior of the casing to help provide support and hydraulic seals between the casing and the surrounding materials.

25 Claims, 21 Drawing Figures

CPI CASING

FIELD OF THE INVENTION

This invention relates to a unit adapted to be attached to a large number of similar units to form an apparatus to permit the taking of geological and geophysical readings and samples and to a geological casing comprising a plurality of the above units joined to each other.

DESCRIPTION OF THE PRIOR ART

INCLINOMETERS

It is common for casings to be placed in wells or drill holes (referred to collectively as wells in this specification) to permit an inclinometer to be inserted inside the casing to measure the inclination of the casing at various depths and at different times. Movement of the surrounding soil or rock can be inferred by noting changes in the inclination of the casing between successive readings. However, the existing inclinometer casings are not suitable for making numerous piezometric measurements to establish and monitor the distribution of fluid or gas pressure on the exterior walls of the casing. Occasionally, the bottoms of existing types of inclinometer casing can be left open so that they can be used to measure fluid or gas pressures to take samples at a single point. However, even in this case it is difficult to ensure that a positive hydraulic seal has been made on the exterior of the casing to ensure the necessary hydraulic isolation of the measuring point.

Inclinometer casing must be securely coupled or connected to the soil or rock walls of a well before changes in the inclination of the casing truly reflect the movement of the surrounding natural material. In the small (2- to 4-inch or 5- to 10-cm) diameter wells commonly used, it is not possible to couple the casings to the soil or rock at all depths in highly permeable materials or below about 50 to 100 meters in sound low-permeability materials. This aspect of the existing casing and installation methods greatly decreases the reliability of the usefulness of such inclinometer readings and increases the amount of deformation and the time that passes before representative readings can be made. Even in the best of conditions there is considerable uncertainty as to the completeness and stability of cement or sand backfill placed from the bottom of the casing or from the top of the well on the outside of the casing. This uncertainty reduces the usefulness of the inclinometer measurements.

Piezometers

It is also common for one or two piezometric (fluid or gas pressure) measurements to be made in a single well and occasionally as many as four different locations are monitored in a single well. However, in these cases separate casings or individual hydraulic or pneumatic tubing are required to reach each piezometer (pressure measuring) location and there is a practical limit of about three to four installations that can be successfully placed in a single well. Another current method of making several piezometer measurements in a single well is to install electrical or electronic devices in the well. However, there is a practical limit to the number of such devices that can be successfully installed and sealed in a well and these devices are very susceptible to errors during longterm monitoring programs as moisture seals tend to leak disturbing the electric or electronic circuitry. These devices are also susceptible to damage from lightning discharges. Existing pneumatic and electrical or electronic devices cannot easily be checked or recalibrated following installation. Thus, the quality of their data cannot be verified.

Existing pneumatic and electrical or electronic piezometers are commonly installed without the use of positive acting packers. Such packers are desirable to seal the well in the annular space between the casing and rock or soil walls and prevent flowing fluids or gas from destroying the seals placed in the well before the cements or grout forming the seals can "set up". Where pneumatic packers have been used to solve this problem there is currently a practical limit of about three or four that can be installed in a single well.

It is common practice to grout or cement casing in place in a well. Current techniques require cement to be mixed at the site and pumped into the well. This results in additional work for the driller, uncertainty about the quantity of cement required and difficulties in estimating the driller's time and the costs.

FLUID AND GAS SAMPLING

When currently available pneumatic, electrical and electronic piezometers are sealed in a well, fluid or gas samples cannot be taken. Therefore, another well must be drilled for fluid or gas sampling. Fluid or gas samples are often taken in wells for analysis of the quality or chemical composition. However, methods of sampling do not permit a high density of sampling points down a well and where such sample points have a high density there are no positive seals placed between the sample locations to minimize the effect of the well on the natural or induced fluid or gas flow surrounding the well.

In lakes and rivers water sampling points should be reoccupied as closely as possible as to depth and location for repetitive tests for samples to be clearly comparable. Also, the sampling tool should have a negligible effect on the existing hydrologic environment during the sampling process.

SUMMARY OF THE INVENTION

The present invention seeks to provide a unit that can be combined with similar units to form an apparatus to permit the taking of geological and geophysical readings. In a first aspect the present invention is a unit adapted to be attached to a plurality of similar units to form an apparatus to permit the taking of geological readings, the apparatus comprising a cylindrical casing having ribs or grooves formed on its interior surface for attitude for orientation and vertical positioning; a coupler adapted to fit on the casings and to provide hydraulic seals between coupler and casings; alignment means formed on the casing and the coupler to co-operate to ensure alignment of the grooves in the casing with grooves in an adjacent casing in the apparatus.

It is desirable that the unit be formed with ports to permit communication of the interior of the apparatus with the external surroundings and that the ports be controlled by valves. If required, each port may be provided with a filter.

It is also desirable that some of the units be formed with an expandable bag (or packer) attached to the exterior of the unit. Ports formed in the apparatus communicate the interior of the unit with the space within the bag so that once the apparatus is installed in a well the bag can be expanded from the interior of the unit to locate, support and hydraulically seal the apparatus in the well.

In a further aspect the present invention provides a geological casing comprising a plurality of units each joinable to a similar unit and each unit comprising a packer segment and a coupler segment. The packer segment comprises a tube; attitude orientation means consisting of ribs or grooves formed on the inner surface of the tube; a passage through the tube from the exterior to the interior which may be provided with a one-way valve; an expandable bag surrounding a portion of the exterior of the tube of each packer segment and attached to the tube near each end of the tube so that a part of the tube extends through the bag at each end, the space between the expandable bag and the tube communicating with the passage through the tube. The coupler segment comprises a tube widened at each end to receive the tube of adjacent packer segments; ribs or grooves formed on the inner surface of the tube of the coupler segment and alignable with the ribs or grooves on the inner surfaces of the adjacent packer segments; a passage in each coupler segment to permit hydraulic communication of the exterior of the apparatus with the interior and where the passage may be provided with a one-way valve; co-operable means on the coupler segment and the packer segment to ensure alignment of the grooves in each segment when the two segments are joined together.

BRIEF DESCRIPTION OF DRAWINGS

The drawings illustrated certain embodiments of the invention, merely by way of example. In the drawings.

DESCRIPTION OF PREFERRED EMBODIMENTS

Figure 1:
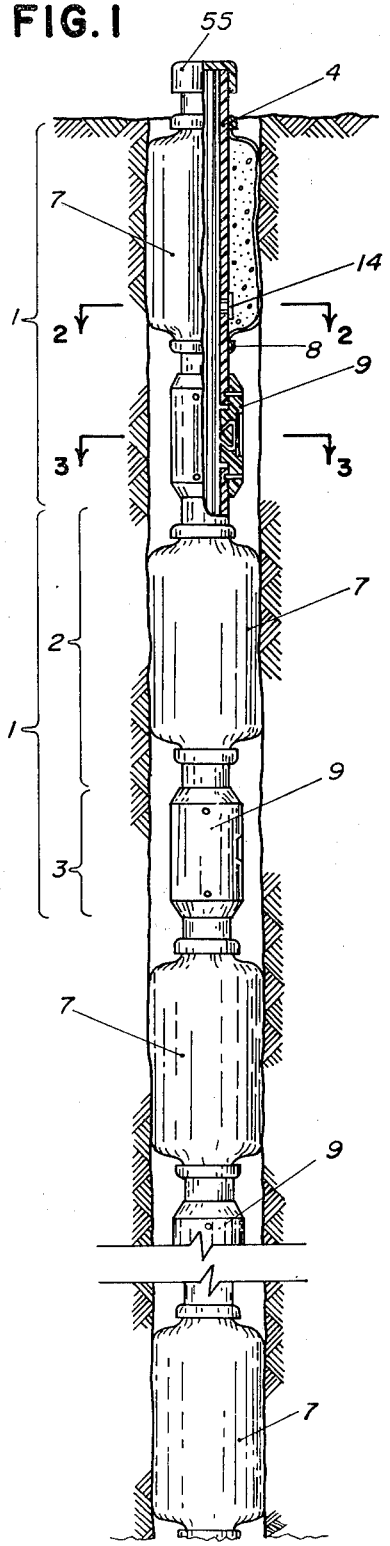
FIG. 1 is an elevation, partly in section, of a geological casing according to one aspect of the invention.

FIGs. 1 to 4 illustrate a geological casing comprising a plurality of units 1 each joinable to a similar unit 1. Each unit 1 comprises a packer segment 2 and a coupler segment 3. The packer segment 2 comprises, as particularly illustrated in FIGS. 1 and 2, a tube 4, which may be of plastic or metal, having at least five grooves 5 formed on the inner surface of the tube. There is a passage 6 through the tube 4 from the exterior to the interior of the tube 4. An expandable bag 7 surrounds a portion of the exterior of the tube of each packer segment 2 and is attached to the tube 4 near each of the tube 4 by sealing rings 8 so that a part of the tube 4 extends through the bag 7 at each end. The space between the expandable bag 7 and the tube 4 communicates with the passage 6 through the tube 4.

Figure 4:
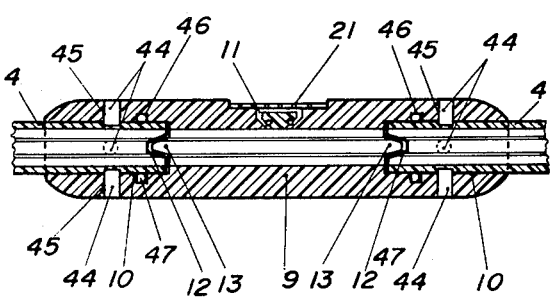
FIG. 4 is an elevation in section, of a measurement coupler.

The coupler segment 3 comprises a plastic or metal tube 9 whose internal diameter is increased at each end 10 to receive the tube 4 of adjacent packer segments 2—see FIG. 4.

Figure 3:
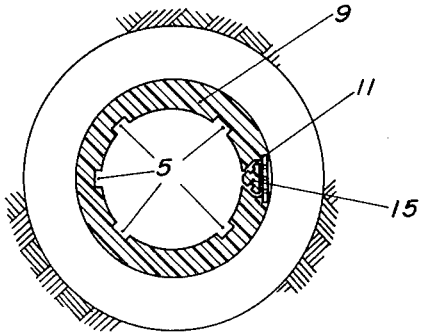
FIG. 3 is a section on the line 3—3 of FIG. 1.

As particuarly illustrated in FIG. 3 there are at least four grooves 5 formed on the inner surface of the coupler segment 3 and each of these grooves are each alignable with a groove 5 on the inner surface of an adjacent packer segment 2. A passage 11 in each coupler segment 3 permits communication of the exterior of the casing with the interior. As shown in FIG. 4 there are co-operable means on the packer segment 2 and on the coupler segment 3 to ensure alignment of the grooves 5 in each segment 2 and 3 when the two segments are joined together. These co-operable means comprise a slot 12 formed in the end of the tube 4 to engage lugs 13 formed on the interior of the tube 9 of the coupler segment 3.

There is a check valve 14 that restricts flow in the passage 6 in the packer segment 2 from the interior of the tube 4 to the space between the tube 4 and the expandable bag 7 as shown in more detail in FIGS. 15 to 19. This check valve 14 may simply comprise a flexible band surrounding the tube 4 of each packer segment 2. It is positioned over the passage 6 through the tube 4.

Figure 5:
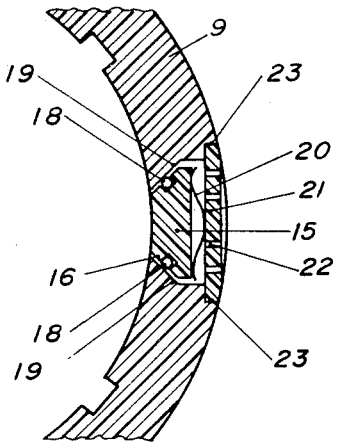
FIG. 5 shows a closed port in a measurement coupler.
Figure 6:
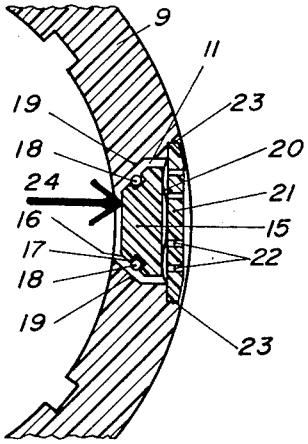
FIG. 6 shows an open port in a measurement coupler.

In addition there is a valve in each coupler segment 3 which forms a valved piezometer port installation that is operable from inside the coupler segment to partially restrict communication between the interior of the tube 9 of the coupler segment with the exterior of the casing through passage 11. As illustrated more particularly in FIGS. 5 and 6, that valve comprises a valve member 15 having an annular inner surface 16 with a recess 17 in this surface to accommodate a sealing O-ring 18. The passage 11 in the coupler segment 3 has correspondingly annular surface 19 to abut the valve member 15 when the valve is closed. There is a spring 20 urging the valve member 15 towards the closed position as shown in FIG. 5. The spring 20 abuts a plate 21 that is provided with openings 22 to permit flow through the plate 21. Plate 21 is engaged in a widened portion 23 of the passage 11 through the coupler segment 3. FIG. 6 shows the valve 15 in the open position when driven by a force or pressure 24 indicated by arrow and acting from the interior of the coupling.

Figure 7:
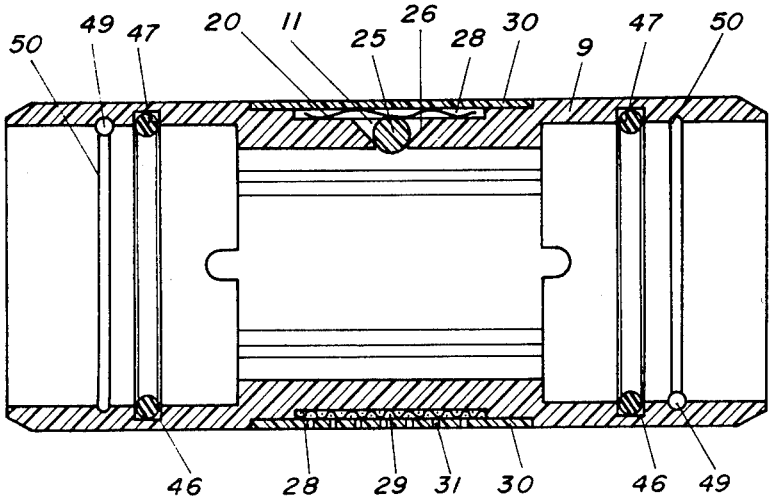
FIG. 7 shows a measurement coupler, partly in section with an alternative valve and joining mechanism from those shown in FIGS. 1, 3, 4, 5 and 6.
Figure 8:
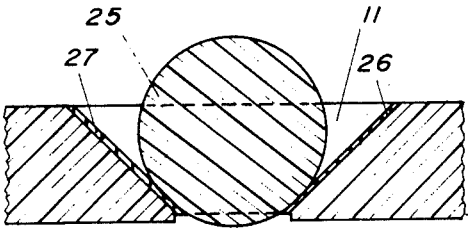
FIG. 8 is a section showing an enlarged view of the valved port shown in FIG. 7.

FIGS. 7 through 10 illustrate two further coupler segments 3 with alternative valve designs. FIG. 7 shows a passage 11 through the tube 9 of a coupler segment 3. The valve in this case is a ball 25 which is seated against the conical shaped wall 26 of the passage 11. An enlarged view of the ball valve and seat is shown in FIG. 8. The wall 26 may be covered by a sealing layer 27. FIG.7 shows a spring 20 urging the ball valve 25 towards the closed position. In the circumferential depression, on the exterior of the coupler tube 9 and centered over the passage 11, required for the space to install the spring 20, the remainder of the space 28 not required for the spring can be filled with a filter material 29 which serves to keep dirt particles from interferring with the operation of the valve 25. This filter is covered by a perforated cover plate 30 which also serves as a reaction to hold the spring 20 in position. The perforations 31 in the cover plate 30 are normally made away from the valve area 25 and passage 11 where the filter material 29 intervenes between the exterior of the valve and the perforations 31 in the cover plate 30.

Figure 9:
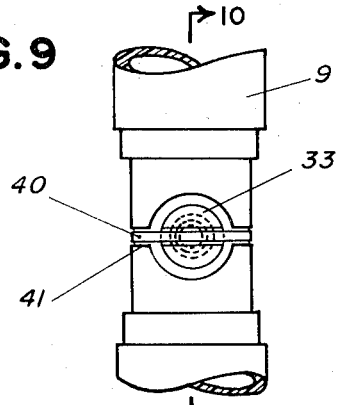
FIG. 9 is an elevation of the exterior of a measurement coupler with an alternative valve from those shown in FIGS. 1, 3, 4, 5, 6, 7 and 8.
Figure 10:
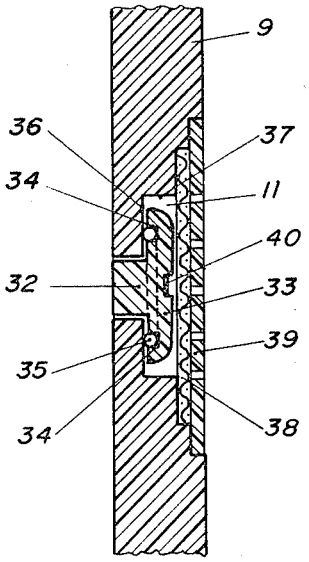
FIG. 10 is an enlarged elevation in section on the line 10—10 of FIG. 9.
Figure 11:
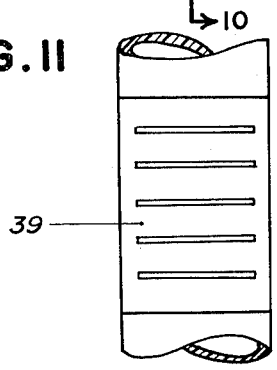
FIG. 11 is an elevation of the exterior of a measurement coupler showing the cover plate with slotted openings.

FIGS. 9 and 10 show an alternative valve system where the passage 11 through the tube 9 of the coupler segment 3 is formed by a series of concentric holes whose walls are parallel with the common axis of these holes, the valve 32 having a head 33. On the underside of the head 33 there is a channel 34 containing an O-ring 35 that abuts against the base 36 of the widened portion 37 of the passage 11. In an alternative method of installing the O-ring seal which is not illustrated the recess for the O-ring could be in the base 36 and the underside of the head 33 would be smooth. A filter member 38 is located beneath a perforated or slotted member 39 as shown in FIGS. 10 and 11.

As illustrated particularly in FIGS. 9 and 10 the head 33 of the valve 32 is held in place by a spring 40. FIG. 9 shows the valve area of the coupling tube 9 with the perforated member 39 of the filter material 38 removed. As illustrated particularly in FIG. 9 the spring is set into a circumferential groove 41 and urges the head 33 of the valve member 32 towards the closed position—the position shown in FIG. 10.

Figure 12:
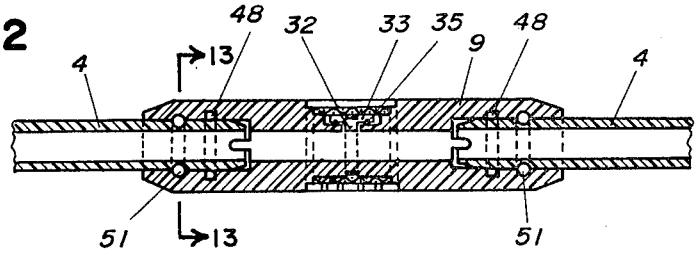
FIG. 12 is a measurement coupler in section illustrating the valved port shown in FIGS. 9 and 10 and joining mechanism shown in FIG. 7.

Concerning the attachment of the coupler segment 3 to the tube 4 of the packer segment, FIG. 4 illustrates the use of shear pins 44 inserted through openings 45 in the coupler segment 3 and extending into the tube 4 where they may be screwed, cemented or otherwise fastened to prevent the joints pulling apart. A recess 46 of the interior of both ends of the tube 9 of the coupler segment 3 contains an O-ring 47. An alternative method of the attachment of the coupler segment 3 to the tube 4 of the packer segment is shown in FIG. 7 where O-rings 47 provide a seal at either end of the coupler segment 3 but where the shear connection of the segments is by flexible shear fasteners which are inserted through a passage 49 into the coupler tube 9 from its exterior surface to fit snugly into co-operable recesses 50 made partly on the interior of the coupler tube 9 and partly on the exterior of the tube 4 of the packer segment. The two matching recesses co-operate so as to fit the shape of the flexible shear fastener. As particuarly illustrated in FIGS. 12, 13 and 14 the shear fasteners 51 are inserted into an opening 49 in the coupler segment which connects to appropriately shaped recesses made along the contact surface between the tube 9 of the coupler segment 3 and the exterior of the tube 4 of the packer segment 2 (recesses 52 being on the interior surface of the tube 9 coupler segment and recesses 53 being on the exterior surface of the tube 4 packer segment).

Figure 13:
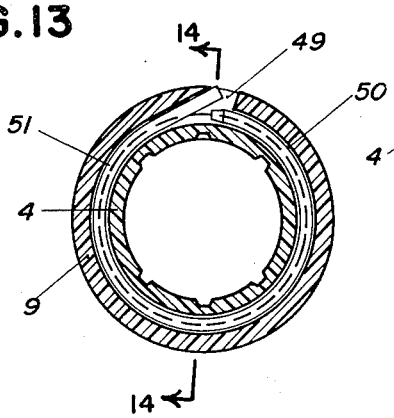
FIG. 13 is a section on the line 13—13 shown in FIG. 12 which shows details of the shear wire fastening mechanism.
Figure 14:
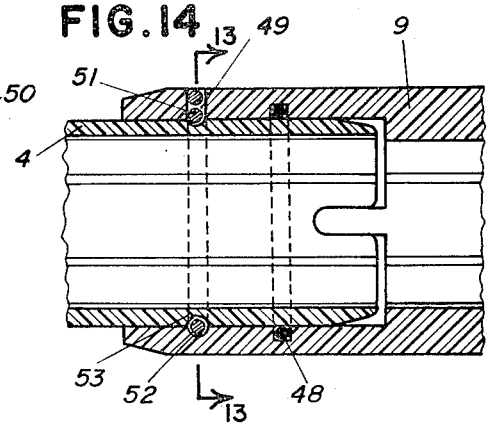
FIG. 14 is an elevation in section on the line 14—14 shown in FIG. 13 showing details of the shear fastening, hydraulic seal (O-ring) and alignment mechanism.

As indicated particularly in FIGS. 13 and 14, one of the six grooves on the interior of the casing segment 4 is interrupted and does not continue into the coupler segment.

As indicated particularly in FIG. 1 the top of the top tube 4 is provided with protective cap 55 to close the tube when it is not being used to make measurements.

Figure 15:
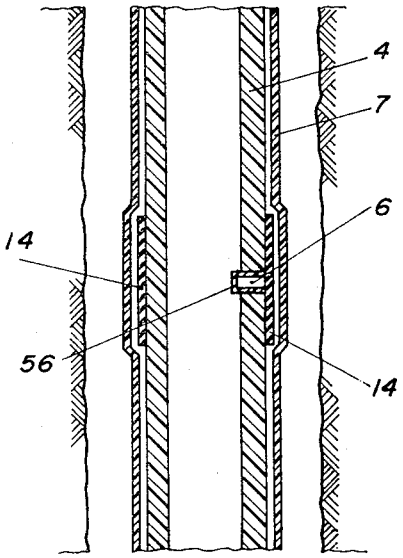
FIGS. 15 and 16 are elevations, in section, of two packers.
Figure 16:
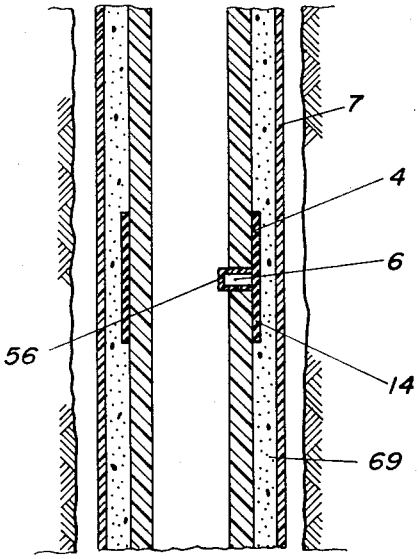

To prevent inadvertent expansion of the expandable bag 7 during, for example, positioning of the unit in the well a protective member 56 closed each passage 6 as indicated in FIGS. 15 and 16. The protective member projects outwardly into the interior of the packer tube 4.

The installation of a unit according to the present invention is illustrated in FIGS. 15 to 21. FIG. 15 illustrates a unit in position and, in this aspect of the invention, the expandable bag 7 does not contain any material. In contrast the embodiment shown in FIG. 16 contains a dry powder, for example Portland cement, cement-powdered metal mixture, a cement and clay mixture, a cement and/or clay mixture with chemical or metallic admixtures, plastic foaming compounds and organic polymers, including acrylic polymers, for example, acrylamide and methylenebisacrylamide which may be used in admixture.

Figure 17:
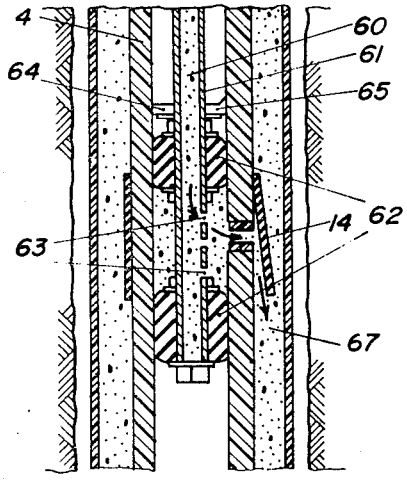
FIG. 17 and 18 are elevations, in section, of two partially inflated packers.
Figure 18:
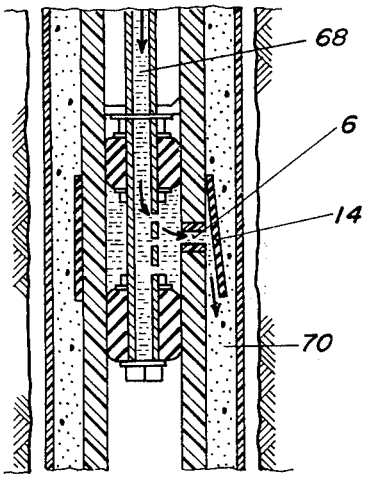
Figure 19:
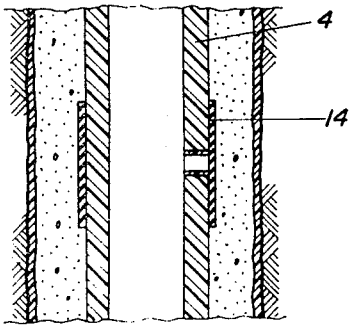
FIG. 19 is an elevation, in section, of an inflated packer.
Figure 20:
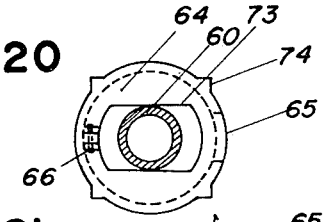
FIG. 20 shows a pre-inflated cap removal tool.
Figure 21:
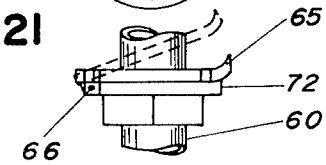
FIG. 21 is an elevation of the tool of FIG. 20.

As illustrated in FIG. 17 a modified drill rod 60 is first inserted into the tube 4 past the passage 6 through which it is desired to pass the packing compound. The drill rod 60 comprises a hollow rod 61 having seals 62 on either side of ports 63. There is an upper member 64 having a blade 65 used to remove the protective member 56 over the passage 6. The drill rod 60 is inserted down the tube 4 until the blade 65 is beneath the protective member 56. The blade 65 is attached to a hinge 66 as shown in FIGS. 20 and 21 so that it lifts up to pass over the protective member 56 when the drill rods 60 are inserted downwards past the passage 6. Upon raising the drill rods slightly blade 65 contacts the protective member 56 and cuts off the protruding end so as to expose the passageway 6. The condition of the protective member 56 and the passageway 6 after the cutting operation is completed is shown in FIGS. 17 and 18. An appropriate grout, cement or the like 67 is then pumped through rod 61 and ports 63 in the case of FIG. 17 or, in the case of FIGS. 16 and 18, water 68 is pumped through and the dry powder 69 is expanded and forms a settable composition 70. The material is pumped through until the condition shown in FIG. 19 is reached, that is until the space between the outer surface of the tube 4 and the interior of the bag 7 is completely filled and the bag fits tightly against the walls of the well. The valve 14 shown in FIGS. 15 to 17 prevents the settable material from flowing back into the interior of the tube 4 through passageway 6.

A variation of the removal device for the protective member 56 for the passage 6 is shown in FIGS. 20 and 21. This device comprises two metal plates 65 and 72 roughly circular in shape and connected by a hinge 66. The upper plate is larger in diameter than the lower plate and has an oval or elongated hole 73 in the center whose major axis is aligned perpendicular to the axis of the hinge 66. Four lugs 74 located on the periphery of the upper plate keep the two aligned in the grooves 5 (see FIGS. 2 and 3) present on the interior of the casing. The lower plate is fastened to the drill rod 60. When pushed into the hole the upper plate lifts up as indicated in FIG. 21 and rides over the protective member. However, when the drill rod 60 is raised the cutting edge 65 of the upper plate engages the protective member 56 and pulls it out or cuts it free.

Once installed the unit of the present invention permits periodic measurement of (1) fluid and gas pressure acting on the exterior of the casing at numerous hydraulically isolated ports; (2) the inclination of the casing; (3) the pressure response of the fluid or gas outside each port and, in addition, permits (4) periodic sampling of fluid or gas to be taken at the ports. The casing of the present invention is alone in the art in permitting all four types of samples or measurements or any combination with no limit to the number of measurements stations or ports that can be installed along the lengths of the casing.

Figure 2:
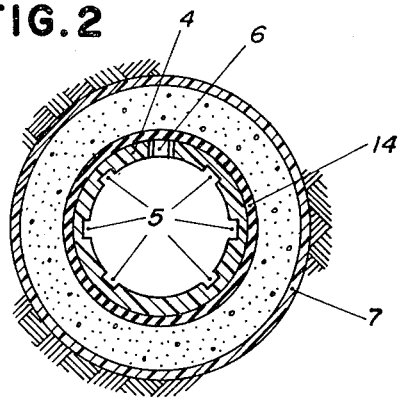
FIG. 2 is a section on the line 2—2 of FIG. 1.

The use of five or six interior grooves in the casing as illustrated by the 6 grooves in FIGS. 2 and 13 and the interruption in the coupler segment of one of the one or two grooves that is not among the four equally spaced grooves as illustrated by the 5 grooves in FIG. 3 provides a means for horizontal alignment and positioning in the vertical plane that contains the axis of the casing and the centre of the measurement ports. This interruption of a groove facilitates the depth location of a measurement port in a coupler and thereby facilitates the operation of the piezometer measurement and water-sampling probes which are operated inside the casing. These extra one or two grooves—compared with the prior art devices—provide a means for locating the precise depth of the ports without affecting the four standard grooves used for inclinometer measurements. The present invention also ensures proper installation of inclinometer casing, cures any existing problem by enabling response tests on piezometers to be made to ensure their reliability.

The invention permits the taking of multiple fluid or gas samples at the same points used for piezometer measurements and also ensures reliable seals on the exterior packer segments on either side of each valved piezometer port installation and allows a virtually unlimited number of piezometer measurements and samplings stations to be installed in the single well. Furthermore, the invention permits reliable multiple piezometer measurements at various depths below the ground surface through valved ports and also the obtaining of bore hole inclinometer measurements in the same location that, at present, require at least two wells. The combined piezometer-inclinometer casing of the invention permits both the measurements to be made in the same well and thus cuts the drilling costs in half and permits multiple fluid or gas samples to be taken and response testing to be done as well. Instead, of there being some compromise in the quality or quantity of one set of measurements in order to accommodate the requirement of another measurement system, there is a marked improvement in the quality and quantity of all types of measurements.

In use the casing according to the present invention is used conventionally, that is the inclinometer that is inserted into the casing is conventional. When not in use the casing may be closed off with the cap 55.

The tubing used for the packer and coupler segments may be made of metal or plastics, the expandable bag used in the packer segment may be of natural or synthetic rubber or plastics with elastic properties.

We claim:

1. Geological and geophysical casing apparatus comprising a unit adapted to be attached by fluid tight seals to a plurality of axially aligned similar units to form an apparatus to permit the taking of geological and geophysical readings and samples by probes moved therethrough, the apparatus unit comprising a cylindrical casing having circumferentially spaced axial grooves formed on its interior surface for orientation and vertical positioning of probes when said probes are moved longitudinally through the casing;

a coupler adapted to connect at one end to said casing and at an opposite end to a similar cylindrical casing of another similar unit;

alignment means formed on the first-mentioned casing and the coupler to co-operate to ensure alignment of the grooves in said first-mentioned casing with grooves in said similar casing in the apparatus when said unit is connected to the similar unit, and stop means at the coupler for the purpose of obtaining a fixed vertical position reference for the probes relative to the coupler.

2. Apparatus as claimed in claim 1 in which said stop means comprises at least one interior groove of the casing discontinued at the coupler this groove need not be continuous throughout the casing segment.

3. Apparatus as claimed in claim 1 in which the coupler is provided with circumferentially spaced axial grooves extending from end to end thereof that align with the grooves in the casing.

4. Apparatus as claimed in claim 1 in which the casing has six grooves on its interior surface.

5. Apparatus as claimed in claim 4 in which the coupler is provided with four circumferentially spaced axial grooves, each aligned with a groove in the interior surface of the casing extending from end to end thereof.

6. Apparatus as claimed in claim 1 formed with ports to permit communication of the interior of the apparatus with the external surroundings.

7. Apparatus as claimed in claim 6 in which each port is provided with a filter.

8. Apparatus as claimed in claim 6 in which the ports are formed in the couplers.

9. Apparatus as claimed in claim 6 in which each port is provided with a seal on its interior side to prevent the ingress of foreign matter from the interior of the apparatus into the interior of the port during installation, the seals being removable once the apparatus has been installed.

10. Apparatus as claimed in claim 6 in which the ports are controlled by valves.

11. Apparatus as claimed in claim 10 in which the valve ports include either a wall converging inwardly towards the interior of the apparatus or a wall converging in one or more steps towards the interior of the apparatus; and comprising a valve member;

a sealing ring or rings formed in the valve or wall members; and means to retain the valve member within the port whereby external pressure forces the valve member towards the interior of the tube so that the sealing ring or rings close the port.

12. Apparatus as claimed in claim 11 comprising a spring or elastic membrane urging the valve member to the closed position.

13. Apparatus as claimed in claim 1 formed with expandable bags attached to the exterior of the cylindrical casing;

ports formed in the apparatus communicating the interior of the unit to the space between the unit and the bags whereby, once the apparatus is installed in a well or drill hole as part of said apparatus, the bags can be expanded from the interior of the unit to locate and otherwise fix the apparatus in the well or drill hole and to prohibit or greatly retard the communication of materials moving along the axis of the well or drill hole in the space between the wall of the well or drill hole and the exterior of the casing.

14. Apparatus as claimed in claim 13 in which the space between the unit and the bag is empty but can be filled with a suitable settable packing material once the apparatus is installed.

15. Apparatus as claimed in claim 13 in which each port is provided with a seal on the interior side of the unit to prevent the premature ingress of foreign matter from the interior of the unit into the port or into the space between the unit and the expandable bags during the installation, the seals being removable at the appropriate time once the apparatus has been placed in the well or drill hole.

16. Apparatus as claimed in claim 13 in which each port is provided with a one-way valve to permit flow from the interior of the casing to the space between the unit and the bags.

17. Apparatus as claimed in claim 16 in which each one-way valve is a resilient tube located on the exterior of the casing over the port.

18. Apparatus as claimed in claim 13 in which the space between the casing and the bag contains a settable material whereby the addition of a fluid from the interior of the unit, through the port, can be used to expand the settable material so that, upon setting, the apparatus is located or otherwise fixed within the drill hole.

19. Apparatus as claimed in claim 18 in which the settable composition is selected from cement and acrylic polymers.

20. Apparatus as claimed in claim 19 in which the acrylic polyer is a mix of acrylamide and methylene-bisacrylamide.

21. Apparatus as claimed in claim 1 in which the fluid tight seals for attaching said unit to another similar unit comprises an O-ring between attached units and a shear ring positioned in circumferential channels in each unit, the channels being aligned to form a passageway for the shear ring.

22. Apparatus as claimed in claim 21 in which the shear ring consists of a flexible rod that can be inserted in the circumferential channel made partially in both the coupler segment and packer segment to prevent the tubes of said segments from coming apart due to a tensile force applied along the axis of the apparatus.

23. Geological casing apparatus comprising a plurality of units each joinable by a fluid tight seal to a similar unit or form an apparatus to permit the taking of geological and geophysical readings and samples by probes, each unit comprising a packer segment and a coupler segment, each packer segment comprising a tube having circumferentially spaced axial grooves formed in the inner surface thereof for orientation and vertical positioning of the probe;

a first port through the tube from the exterior to the interior;

an expandable bag surrounding a portion of the exterior of the tube of said packer segment and attached to the tube near each end of the tube so that a part of the tube extends through the bag at each end, the space between the expandable bag and the tube communicating with the passage through said port;

the coupler segment comprising a tube shaped at each end to connect with the tube of a packer segment aligned therewith;

said coupler segment tube having circumferentially spaced axial grooves formed on the inner surface thereof and alignable with grooves on the inner surface of a packer segment connected thereto; and a second port through the tube of the coupler segment to permit communication of the exterior of the apparatus with the interior thereof.

24. A casing as claimed in claim 23 including cooperable means on each coupler segment and each packer segment to ensure alignment of the grooves in each segment when the two segments are joined together.

25. Apparatus as claimed in claim 23 in which at least one interior groove of the packer segment is discontinued at the coupler segment for the purposes of obtaining a vertical position reference, this groove need not be continuous throughout the casing segment.

* * * * *